US006489276B1

(12) United States Patent
Gibbs

(10) Patent No.: US 6,489,276 B1
(45) Date of Patent: Dec. 3, 2002

(54) CLEANING COMPOSITION FOR MEDICAL INSTRUMENT

(75) Inventor: Anthony Marston Gibbs, Gt. Yarmouth (GB)

(73) Assignee: Ebiox Limited, Ilkley (GB)

( * ) Notice: Subject to any disclaimer, the term of this patent is extended or adjusted under 35 U.S.C. 154(b) by 0 days.

(21) Appl. No.: 09/786,942

(22) PCT Filed: Sep. 23, 1999

(86) PCT No.: PCT/GB99/02969

§ 371 (c)(1),
(2), (4) Date: Mar. 12, 2001

(87) PCT Pub. No.: WO00/18858

PCT Pub. Date: Apr. 6, 2000

(30) Foreign Application Priority Data

Sep. 25, 1998 (GB) ..... 9820863
Apr. 28, 1999 (GB) ..... 9909724

(51) Int. Cl.[7] ..... C11D 3/48; C11D 3/04

(52) U.S. Cl. ..... 510/161; 510/245; 510/356; 510/384; 510/391; 510/421; 510/504; 510/510; 510/511

(58) Field of Search ..... 510/161, 245, 510/356, 384, 391, 421, 504, 510, 511

(56) References Cited

U.S. PATENT DOCUMENTS

H269 H * 5/1987 Malik ..... 422/37

FOREIGN PATENT DOCUMENTS

| | | | |
|---|---|---|---|
| EP | 691421 | * | 1/1996 |
| GB | 676895 | | 8/1952 |
| WO | WO96/26796 | | 9/1996 |

* cited by examiner

*Primary Examiner*—Charles Boyer
(74) *Attorney, Agent, or Firm*—Jenkins & Wilson, P.A.

(57) ABSTRACT

The present invention concerns a composition and a method for cleaning instruments and the like. More particularly, it is concerned with compositions for removal of body fluid from surgical instruments and other surfaces such as operating tables and instrument trays.

14 Claims, No Drawings

CLEANING COMPOSITION FOR MEDICAL INSTRUMENT

TECHNICAL FIELD

The present invention concerns compositions for cleaning instruments and the like. More particularly, it is concerned with compositions for removal of body fluid from surgical instruments and other surfaces such as operating tables and instrument trays.

BACKGROUND OF THE INVENTION

In medical environments, there are several types of soils which contaminate surgical instruments and surfaces in or around an operating theatre. The invention relates to compositions for washing such surfaces, and is particularly concerned with an improved method and composition for the removal of body fluids and soils from surgical instruments and similar medical equipment.

Blood is the most difficult type of stain to deal with in that it contains complex iron molecules i.e. hemoglobin molecules. Blood stains are difficult to remove because they tend to harden and become fixed by conventional detergent mixtures.

A number of chemical methods have tried to reduce staining by the action of hemoglobin on metals and other surfaces. For reasons which are not understood, the iron content within the hemoglobin tends to become more insoluble in the presence of surface active agents.

Fats are another type of stain frequently encountered. These are easily solubilised or emulsified by conventional detergents. However, in the presence of iron i.e. hemoglobin which acts as a catalyst, liquid fats can harden. Thus fats in conjunction with blood can be difficult to remove. In this state, inert soils such as surgical lubricants, usually silicones, can become embedded and thus difficult to remove. Similarly, other soils including soluble and semi-soluble carbohydrates can also become bound up.

Biological soils such as pus and other waste from microbic activity also often encountered in these environments. These type of soils are insoluble in water and surfactants and thus their removal causes problems.

As a consequence of the technical advances in medicine over the last few years there is now a wide range of materials used in the manufacture of surgical instruments. Hence there are a number of substrates on which soils can be deposited which include metals such as stainless steels, plastics, ceramics and glass.

A wide range of surfactant formulations are known for removing body fluid soils. These are varying effectiveness. Apart from body fluid soils, problems arise with the formation of insoluble deposits arising from water and from the presence of metals, such as aluminium which leads to the formation of alumina scale. Iron oxide or rust staining is also a problem which arises from the presence of hemoglobin in blood stains. Certain sequestering agents are commonly used to inhibit scale formation but these may suffer from instability which presents a safety problem as the decomposition products may be harmful or render the sequestering agent ineffective.

Conventional surfactants include polyphosphates. These essentially function as sequestering agents for hard water salts ie they act as a water softener. However, such conventional surfactants are not capable of dissolving rust stains, nor are they capable of preventing the formation of alumina scale.

Another common cleaning agent is the complexing agent EDTA. This is perfectly suitable for sequestration of calcium and particularly for the prevention of precipitation of more highly insoluble calcium salts such as calcium phosphate. However, this compound can be unstable at high pH, with the breakdown products being corrosive. This agent also has no effect on rust stains.

Other sequesterants have been used, but they all suffer disadvantages in one way or another and frequently there is less than 100% removal of soils arising from body fluids.

Conventional soil removal systems are generally high pressure high temperature washing machines such as autoclaves. There are other machines which work at lower temperatures for cleaning heat labile equipment. Hand-hot water is used for hand washing instruments and similar equipment.

A commonly used method of washing large numbers of surgical instruments is by batch washing or continuous washing in a suitable machine such as an autoclave or the equivalent to a domestic washer. Also certain instruments are cleaned by ultra-sonic equipment containing either a water based cleaning solution or an organic solvent.

Conventional methods of cleaning instruments suffer the problem that a thin layer of material frequently remains on the instrument after cleaning. Although this material may be rendered inactive by the cleaning agent and thus be unable to propagate, there is still the problem that any layer of material which remains on the instrument after cleaning will act as a nutrient for any microbial organisms which come into contact with the instrument, thereby representing a potential health hazard.

Once cleaned by a conventional method, the instruments are sterilised by heat with or without chemical support.

It is during the heat-sterilising process that any soiling left on the instruments will carbonise. This has the disadvantage that the presence of carbonised deposits could have an adverse effect on the performance of the instrument.

DISCLOSURE OF THE INVENTION

It is an object of the present invention to provide improved cleaning compositions which are capable of removing substantially all contaminating material from surgical instruments. It is also an aim of the invention to provide compositions which are compatible with a wide range of materials encountered in the medical field. It is a further object to provide compositions. which are effective at ambient room temperature and/or at elevated temperatures such as those found in hospital washing equipment. It is thus intended that the compositions of the present invention effect substantially complete and safe removal of soiling. It is hence an aim that the compositions of the invention are easy to handle and use and do not in themselves present a health risk.

It is also an aim of the invention to overcome the disadvantages of conventional cleaning agents as described above. In particular, instruments cleaned using the compositions of the present invention may not need a further heat sterilising treatment.

DETAILED DESCRIPTION OF THE INVENTION

According to the present invention there is provided a method for cleaning medical equipment and surgical instruments; the method comprising applying to the medical equipment and surgical instruments a composition comprising by weight:

| | |
|---|---|
| a metal silicate or silicate complex | 2.0 to 20.0%; |
| a metal phosphate or polyphosphate, or orthophosphoric acid | 1.0 to 50.0%; |
| a non-ionic or amphoteric surfactant | 1.0 to 15.0%; |
| a quaternary ammonium salt | 1.0 to 3.0%; |
| with the balance of the composition comprising de-ionised water or a solid bulking agent; the composition optionally including one or more of: | |
| a sequestering agent | 0.5 to 3.0%; |
| an oxygen donor | 0.1 to 50.0%; |
| an alcohol | 5.0 to 25.0%; |
| a polysaccharide | 0.01 to 0.50%; |
| cationic surfactant or source of cations | 1.0 to 3.0%; |
| and; colours, fragrances, and/or anti-foaming agents | as required. |

The substantially complete and safe removal of soiling is achieved by using this method in a number of ways including physiochemical and chemical transformation or alteration of the soiling to enable removal. These compositions are directed solely towards soil removal from surgical instruments and associated equipment. Soiling in this context refers to all types of contamination usually encountered in such circumstances and ranges from inorganic materials to microbic organisms. In the medical field, the main criterion is safety, followed by effectiveness and ease of use. The compositions of the present invention provide exactly these benefits.

Preferably, the metal cation in the silicate or silicate complex is an alkali metal cation or an ammonium cation. More preferably, the cation is sodium. In the case of liquid formulations, preferably there is 2.0 to 6.0% of the silicate or meta-silicate present; and in the case of solid formulations there is preferably 15.0 to 20.0% present. The silicate complex may be in the form of a meta-silicate, ortho-silicate, thio-silicate, pyro-silicate and other similar complex silicates.

Ideally, the metal phosphate or polyphosphate is present as an alkali metal or ammonium phosphate and the phosphate may be mono-, di- or tribasic. Tetrasodium pyrophosphate is the most preferred phosphate. In the case of a liquid formulation, there is preferably 1.0 to 10.0% of the phosphate or polyphosphate present, and in the case of solid formulation there is preferably 40.0 to 50.0% present.

Orthophosphoric acid may also be used in place of the metal phosphate or polyphosphate.

Any conventional non-ionic surfactant may be used in the compositions of the present invention. However, the surfactant of choice is NP-9 (nonyl phenol ethoxylate) which is available from ICI under the trade name Synperonic N.

The non-ionic surfactant of choice is NP-9 because of compatibility with other components and low foam or reduced foaming at elevated temperatures. This is important where both elevated temperatures and pressures are used in surgical instrument washing machines. Preferably, in the case of liquid formulations there is 8.0 to 12.0% of the non-ionic surfactant present; and in the case of solid formulations there is 1.0 to 5.0% present.

Amphoteric surfactants may also be used in the compositions of the present invention in the same amounts as for non-ionic surfactants. The type of non-ionic or amphoteric surfactant and the chain length will depend on the reactivity needs of the formulation and may readily be determined by experimentation. It is, however, important for the isoelectric point to be higher than pH7. Carboxylated imidazolenes are the preferred amphoteric surfactants.

The quaternary ammonium salt acts as a complexing agent and may be derived from a lower alkyl amine having one or more alkyl substituents each being $C_6$ or less and a single substituent including an aryl group. Preferably, the quaternary ammonium salt is lauryl benzyl ammonium chloride, or cetyl trimethyl ammonium bromide, or 1-aminoethyl, 2-alkylimidazoline. Preferably there is 1.5 to 2.0% of the quaternary ammonium compound present in the solid or liquid formulations of the present invention.

The sequestering agent, when present, serves to enhance the fat- and protein-removing ability of the compositions of the present invention and interacts with the quaternary ammonium compound. This is not, however, an essential ingredient. This component when included is intended to sequester metal ions and the most suitable sequestering agent will be in part determined by the other components of the composition. Preferred sequestering agents are one or more of the following: citrates, formates, tartrates, gluconic acid, and 126-hexantriol thioglycolate. EDTA is also acceptable but is far less effective than 126-hexantriol thioglycolate which is particularly preferred. The citrates and/or formates which thus may be independently present or may be present in combination are preferably in the form of their alkali metal or ammonium salts. Sodium or ammonium citrate is the preferred citrate and sodium formate is the preferred formate. In the case of liquid formulations, preferably the sequestering agent is 126-hexantriol thioglycolate; and in the case of solid formulations the sequestering agent is preferably sodium citrate, sodium formate or a mixture thereof. In the case of liquid formulations, preferably there is 0.5 to 1.0% of the sequestering agent present; and in the case of solid formulations there is preferably 1.0 to 2.0% present.

The oxygen donor, when present, serves to loosen contaminants from the surface being cleaned and is particularly advantageously incorporated in liquid formulations. Preferably, the oxygen donor is an aluminium alkoxide, with aluminium triethoxide being the compound of choice. The oxygen donor is preferably present in an amount of 0.1 to 2.0% and more preferably in the amount of 0.5 to 1.0%. The oxygen donor has the effect of significantly improving the cleaning of non-metallic materials, and in particular plastics. Other suitable oxygen donors include perborates but in general these require higher temperatures than the aluminium alkoxides. Percarbonates, manganese salts, hydrogen peroxide or oxyhalides also represent suitable oxygen donors.

The polysaccharide, when present, is present in an amount of 0.01 to 0.5% by weight, and more preferably in an amount of 0.1 to 0.5% by weight. The polysaccharide is believed to provide a number of advantages to the compositions, the most important being its effect in improving the functions of the other components. It is believed that this enhancement may be due to the polysaccharide affecting the ionic properties of the composition with the result that the active ingredients are more evenly coated onto the surface to be treated. Consequently, substantially all soiling can be removed and prevented from re-depositing on clean surfaces. Particularly preferred polysaccharides include D-glucosyl, D-manosyl, and D-glucisyluronic acid which has a primary structure of a cellulose backbone with trisaccharide side chains and pentasaccharide repeating units.

If the formulation is a liquid formulation, the balance of the composition is de-ionised water with the balance of the composition optionally including an oxygen donor to enhance the cleaning properties of the composition. Alcohol, colours and fragrances may also be optionally included in the liquid formulations. The alcohol may be monohydric or polyhydric, with isopropyl alcohol being preferable. The preferred amount of alcohol, when present, is from 5.0 to 10.0%.

If the formulation is a dry powder formulation, the balance of the composition is provided by a solid bulking agent which serves to absorb any water present in the non-ionic surfactant or other components thereby providing a dry composition.

The cationic surfactant or source of cations, when present, is intended merely to moderate the activities of the other components and as such represents an optional component.

Powder formulations are obtained by incorporating the active components in the powder. Sodium carbonate is a particularly preferred vehicle because it can be easily incorporated into a formulation, it provides an ideal base for incorporating the active chemicals and it also contributes towards water softening. There is also the advantage that the pH of the solution will remain above pH 9. Other suitable powders include magnesium sulphate, potassium carbonate, sesquicarbonate, sodium bicarbonate and borax. Optionally, an oxygen donor, colours and fragrances may be included in the balance of the solid composition.

The essential part of the formulation consists of a surfactant, a metal silicate or meta-silicate as an emulsifier, a metal phosphate as a water softener, and a quaternary ammonium compound as a complexing agent. The alcohol, when present, has the effect of improving the appearance of the solution by improving its clarity.

The exact relationship between the components is not clear but it is believed that they interact with one another in a synergistic manner. However, it is thought that the silicates have wetting, emulsifying and soil suspending properties and the polyphosphates function by sequestering hard water salts.

Silicates and meta-silicates also have a good buffering action, which means that in the presence of acidic soils, an alkaline pH is maintained almost until they have been exhausted. Medical soils are, in general, acidic, and the buffering action of silicates is essential. Not all stainless steels are totally "stainless", and the presence of silicates, coupled with the presence of phosphates or polyphosphates will inhibit corrosion; this is especially important at points where a mild steel pin joins two stainless steel components. Silicates also inhibit aluminium alloy corrosion, especially when polyphosphates are present.

There also appears to be some improved surface activity when phosphates or polyphosphates are used in conjunction with non-ionic surfactants. A secondary function of the phosphates appears to be as a soil suspending agent which allows lifted soils to be rinsed away more easily. In many surgical cleaning formulations, lifted soils tend to redeposit, thus contributing to the residual soil levels after cleaning. The compositions of the present invention therefore do not suffer this disadvantage.

Citrates are soluble salts and the inclusion of an alkali-metal or ammonium citrate, together with an alkali-metal (preferably sodium) or ammonium formate in the formulation results in even greater soil lifting capability and those materials function as sequesting agents in the compositions of the present invention. This is particularly noticeable in the case of body fats which can be readily removed by the compositions of the invention. This is probably due to fat being more easily emulsified thus requiring less silicate.

To overcome the problem that the inclusion of both polyphosphates and silicates still does not provide any sequestering activity against iron, the compositions of the present invention incorporate a sequestering agent which functions to enhance the removal of hemoglobin. The sequestering activity of 126 hexantriol thioglycolate in particular was investigated and even at very low inclusion rates, very effective blood removal was achieved.

The preferred sequestering agent for iron removal is 126 hexantriol thioglycolate. In the presence of a quaternary ammonium compound the activity of this component appears to be enhanced considerably thus allowing very small inclusion rates in the compositions of the present invention.

In some medical soil removal applications (for; example the cleaning of heat sensitive equipment), the presence of oxygen is beneficial. Aluminium tri-ethoxide gives the best results but other aluminium alkoxides are also effective. Formulations containing aluminium triethoxide give excellent results when used to remove mucus and other soils from endoscopes and similar investigative instruments. Results both in soil removal and microbe control (which is a function of soil removal) where superior when compared with conventional aldehyde or other cleaning solutions.

The oxygen donor is thought to provide oxygen at the liquid/polymer surface where its activity enhances soil removal from most plastic materials and in particular from nylon 66 and polypropylene. Exceptional soil removal has been observed when cleaning endoscopes and similar instruments including oxygen masks where elevated temperatures cannot be used.

Depending on the particular application intended for a composition useful in the method a number of additional components can be incorporated within the formulations of the present invention. These include foam control agents, which preferably are silicones. Colours and fragrances may also be included as required. The percentage of these components in the composition are determined by end use requirements.

The following examples are illustrative of the invention.

EXAMPLE 1

A solid state formulation for cleaning surgical instruments was made by mixing the following solid state components:

| | |
|---|---|
| Sodium carbonate | 32% |
| Sodium metasilicate | 15% |
| Tetra sodium pyrophosphate | 45% |
| Non ionic surfactant | 5% |
| Quaternary ammonium compound | 1.5% |
| Ammonium citrate | 0.5% |

An aqueous solution of this formulation was prepared for use as a cleaning composition by dissolving 10 g of the composition in one litre of water. This solution was then used for washing a variety of surgical instruments which were contaminated with known soils and micro organisms for the purpose of providing an indication of the efficacy of soil removal. The aqueous composition of the invention showed superior soil removal results at a level not hitherto achievable by conventional cleaning agents. Cleaning also removed material which would otherwise protect micro organisms from subsequent exposure to disinfectants and sterilants.

Using this solution enabled a bright appearance to be maintained on new metal instruments. The solution also removed tarnish, and thus improved the brightness of stainless steel instruments. Rust stains at pivot points were also removed or prevented, and edged instruments maintained sharpness after treatment with the composition.

EXAMPLE 2

A concentrated liquid formulation for use in surgical instrument washing equipment was prepared from the following components:

| | |
|---|---|
| Non ionic surfactant | 8% |
| Sodium metasilicate solution | 5% |
| Tetra sodium pyrophosphate solution | 8.0% |
| Quaternary ammonium compound | 2% |
| 126 hexantriol trithioglycolate | 0.5% |
| IPA | 10.0% |
| Polysaccharide | 0.1% |
| De-ionised water | 66.4% |

Using this solution either concentrated or in dilute form for washing surgical instruments gave metal instruments a bright appearance. A composition of this type is particularly suitable for instrument washing equipment of the type in which the cleaning a fluid and water are metered in. Typically, when used in diluted form, 1 part of this composition may be diluted with 10 to 100 parts water. Similar soil removal levels were obtained using this formulation as were obtained with the powder formulation of Example 1.

EXAMPLE 3

The formulation of this example was designed for soil removal from surgical instruments under conditions where oxygen release would be an advantage. A concentrated liquid formulation was prepared from the following components:

| | |
|---|---|
| Non ionic surfactant | 12% |
| Sodium metasilicate | 3% |
| Tetra sodium pyrophosphate | 3.0% |
| Quaternary Ammonium compound | 2.0% |
| Sodium citrate | 1.5% |
| 126 hexanetriol trithioglycolate | 0.5% |
| Aluminium Triethoxide | 1.0% |
| De-ionised water to 100% | |

Suitable applications are, for example, cases in which plastic materials need to be cleaned prior to autoclaving or disinfection. Heat sensitive materials such as masks and tubing can also be thoroughly cleaned at lower temperatures using this composition without surface damage occurring, or without the absorption of chemicals which could be subsequently released under the reduced pressures encountered when administering gaseous surgical anaesthetics. This composition is very effective at ambient or slightly raised temperatures i.e. lower than the temperatures usually encountered with larger surgical instrument washing machines.

The dilution rates for this liquid formulation will depend on the type of machines and degree of soiling encountered. In practical terms, dilution of between 10 ml and 50 ml of the liquid formulation per litre of wash water is gives good results.

In general the liquid formulations useful in the method of the present invention may be used either in concentrated form or at dilutions up to 100 times. Solid formulations may be diluted with water and are preferably diluted in the range 5 g to 100 g of solid composition per litre of water, and more preferably in the range 5 g to 10 g of solid composition per litre on the combined grounds of efficiency and economy.

The compositions useful in the method of the invention, whether in solid or liquid form are highly effective when used for cleaning surgical instruments and medical equipment. In use, a solid composition is dissolved in water and applied to the surface to be treated. A liquid composition may be applied neat to the surface or may be diluted with water prior to treatment of the surface.

What is claimed is:

1. A method for cleaning stainless steel or plastic medical equipment and surgical instruments, the method comprising applying to stainless steel or plastic medical equipment and surgical instruments a composition comprising by weight:

| | |
|---|---|
| a metal silicate or silicate complex | 2.0 to 20.0%; |
| a metal phosphate or polyphosphate, or orthophosphoric acid | 1.0 to 50.0%; |
| a non-ionic or amphoteric surfactant | 1.0 to 15.0%; |
| a quaternary ammonium salt | 1.0 to 3.0%; |
| with the balance of the composition comprising de-ionised water or a solid bulking agent; the composition optionally including one or more of: | |
| a sequestering agent | 0.5 to 3.0%; |
| an oxygen donor | 0.1 to 50.0%; |
| an alcohol | 5.0 to 25.0%; |
| a polysaccharide | 0.01 to 0.50%; |
| cationic surfactant or source of cations | 1.0 to 3.0%; |
| and; colours, fragrances, and/or anti-foaming agents | as required. |

2. A method as claimed in claim 1, wherein the metal cation in the silicate or silicate complex is an alkali metal cation or an ammonium cation.

3. A method as claimed in claim 1, wherein in the case of liquid formulations there is 2.0 to 6.0% of the silicate or complex silicate present; and in the case of solid formulations there is 15.0 to 20.0% of the silicate or complex silicate present.

4. A method as claimed in claim 1, wherein the metal phosphate or polyphosphate is present in an alkali metal or ammonium phosphate and the phosphate may be mono-, di- or tribasic.

5. A method as claimed in claim 1, wherein in the case of a liquid formulation, there is 1.0 to 10.0% of the phosphate or polyphosphate present, and in the case of solid formulation there is 40.0 to 50.0% of the phosphate or polyphosphate present.

6. A method as claimed in claim 1, wherein the surfactant is nonyl phenol ethoxylate.

7. A method as claimed in claim 1, wherein in the case of liquid formulations there is 8.0 to 12.0% of the non-ionic surfactant present; and in the case of solid formulations there is 1.0 to 5.0% of the non-ionic surfactant present.

8. A method as claimed in claim 1, wherein the quaternary ammonium salt is derived from a lower alkyl amine having one or more alkyl substituents each being $C_6$ or less and a single substituent including an aryl group.

9. A method as claimed in claim 1, wherein there is 1.5 to 2.0% of the quaternary ammonium compound present.

10. A method as claimed in claim 1 wherein the oxygen donor is an aluminum alkoxide.

11. A method as claimed in claim 1, wherein the oxygen donor is present in an amount of 0.1 to 2.0%.

12. A method as claimed in claim 1, the method further comprising the step of:

(a) diluting the composition with water, before applying the composition to the surface.

13. A method as claimed in claim 12, wherein the composition is in liquid form and the dilution is in an amount of between 10 ml and 100 ml of the liquid composition per liter of water.

14. A method as claimed in claim 12, wherein the composition is in solid form and the dilution is in an amount of between 5 g and 100 g of the solid composition per liter of water.

* * * * *